US008495808B2

(12) United States Patent
Darby

(10) Patent No.: US 8,495,808 B2
(45) Date of Patent: Jul. 30, 2013

(54) METHOD FOR REPLACING A SEAT COVER

(75) Inventor: Charles W. Darby, Miami, FL (US)

(73) Assignee: Charles Darby

( * ) Notice: Subject to any disclaimer, the term of this patent is extended or adjusted under 35 U.S.C. 154(b) by 227 days.

(21) Appl. No.: 12/800,777

(22) Filed: Jun. 21, 2010

(65) Prior Publication Data

US 2010/0299900 A1 Dec. 2, 2010

Related U.S. Application Data

(60) Provisional application No. 61/183,159, filed on Jun. 2, 2009.

(51) Int. Cl.
*A47C 7/00* (2006.01)

(52) U.S. Cl.
USPC ..... 29/402.08; 29/402.01; 29/402.03; 29/402.09; 29/402.12; 297/218.1; 297/219.1; 297/228.12; 297/228.13; D6/611

(58) Field of Classification Search
USPC ..... 29/91–91.1, 402.01, 402.03, 402.08, 29/402.09, 402.12, 402.14; 297/218.1, 219.1, 297/228.12, 228.13; D6/611
See application file for complete search history.

(56) References Cited

U.S. PATENT DOCUMENTS

| | | | | |
|---|---|---|---|---|
| 1,209,586 | A * | 12/1916 | Jensen | 297/218.1 |
| 3,065,031 | A * | 11/1962 | Henry | 297/450.1 |
| 3,722,950 | A * | 3/1973 | Harnick | 297/218.1 |
| 5,529,373 | A * | 6/1996 | Olson et al. | 297/218.4 |
| 5,768,758 | A * | 6/1998 | Deignan et al. | 29/91.1 |
| 6,270,162 | B1 * | 8/2001 | Jeny | 297/440.22 |
| 6,935,698 | B1 * | 8/2005 | Chen | 297/440.22 |
| 7,066,550 | B1 * | 6/2006 | Su | 297/440.22 |
| 8,128,166 | B2 * | 3/2012 | Hoshina et al. | 297/218.4 |
| 2002/0002854 | A1 * | 1/2002 | Imoto et al. | 73/1.13 |
| 2002/0117885 | A1 * | 8/2002 | Barile et al. | 297/452.52 |
| 2004/0155499 | A1 * | 8/2004 | Chambers et al. | 297/228.1 |

* cited by examiner

*Primary Examiner* — Peter DungBa Vo
*Assistant Examiner* — Anthony Green
(74) *Attorney, Agent, or Firm* — John Rizyi

(57) ABSTRACT

Method for replacing a seat cover, comprising said method the following steps:
a) removing screws from underside of chair;
b) removing the padded seat (with the upholstery to be replaced) from the chair frame;
c) placing a new cover over the old padded seat stretching all around the cover edge of the new cover to fit firmly to the padded seat;
d) locating four reinforced corners on the new cover;
e) attaching elasticized band provided top right to bottom left, top left to bottom right;
f) replacing the reupholstered seat to the chair frame, and
g) re-fasten the reupholstered chair seat to the chair frame.

3 Claims, 1 Drawing Sheet

METHOD FOR REPLACING A SEAT COVER

This application claims the benefit of U.S. Provisional Application No. 61/183,159, filed Jun. 2, 2009

BACKGROUND OF THE INVENTION

1. Field of the Invention

This invention relates generally to the replacement of covers for dinning room chairs, and more particularly to a method for replacing a seat cover by using simple and economical means transforming a reupholstering procedure into an easy, do-it-yourself procedure.

Even more particularly the present invention relates to a method for reupholstering dining seat covers comprising several basic simple steps, involving removing the old padded seat, covering it with new upholstery and replace the seat to the chair, using practical and economical maneuvers and tools.

2. Description of the Prior Art

The fabric of the upholstery of dining chairs seats, particularly those made of woven material, are subject to wear, causing fraying of the material and sometimes are also subject to staining, tearing, etc. All these factors have a strong negative impact on the chairs and the furniture these chairs are party of. Therefore reupholstering of the seats is required. Such reupholstering is not only expensive but requires a person skilled in such work that should perform several difficult maneuvers including: removing the seat, cutting the upholstering material to fit the removed seat, folding the edges to pass around the chair corners, securing the new fabric to the chair frame and replacing the seat. While the skill person is performing those tasks, the user cannot use the chairs with all the inconveniences involved.

Users usually want to recover worn out dining room chairs because they are usually an expensive piece of furniture. Sometimes the entire structure of the chair is in perfect condition but the poor condition of the upholstery deteriorates the general aspect of the furniture set. The present invention readily addresses the above mentioned needs by a do-it-yourself method comprising several easy steps using simple tools almost any person can use.

There are several known methods and means in the art for replacing a seat cover for dining room chairs. One of them comprises a normally flat blank of stretchable knitted material having a front edge, edges diverging from said front edge, substantially parallel side edges, a curved rear edge and curved edges connecting said curved rear edge and side edges stretchable material, when extended, attached to said edges throughout their entire length.

It is also known a one-piece plastic cover for a seat of a dining chair, comprising a single layer of polyvinyl chloride polymer having broad double polished top and bottom surfaces of sufficient tackiness to adhere to each other but allow fabric associated with clothes of the user to slide without adherence thereover. The top and bottom broad surfaces of the cover are constructed of a generally rectangular shape wherein the broad surfaces terminate in a front edge, a pair of side edges, a rear edge.

Yet also known is a furniture slipcover having an elastic band stitched at selected positions along the inside of the cover such that when the cover is placed on a furniture piece, such as a sofa or chair, the cover takes the shape of the furniture piece, thus eliminating the time consuming and expensive steps which are currently required to fit a cover to the furniture piece. Elastic bands are also provided which enable the cover to be gathered at desired portions such that the cover has a fitted and shaped look. Pluralities of elastic ties are formed on the inside of the cover and are used to secure the cover to the furniture piece by tying it around the furniture seat cushions.

Therefore, a reliable, easy to use method for replacing a seat cover is still desired.

SUMMARY OF THE INVENTION

This invention is directed to a method for replacing a seat cover, comprising said method the following steps:

a) removing screws from underside of chair;
b) removing the padded seat with the upholstery to be replaced;
c) placing a new cover over the old padded seat stretching all around the cover edge of the new cover to fit firmly to the padded seat;
d) locating four reinforced corners on the new cover;
e) attaching elasticized band provided top right to bottom left, top left to bottom right; and
f) replacing the reupholstered seat to the chair frame and re-fasten the screws.

In one general aspect of the present invention, the method for replacing a seat cover comprises:

removing the screws from the underside of the dinning room chair with provided screw driver,
lifting the padded seats,
placing the do-it-yourself cover over the padded seat,
providing hooks with elasticized stretch bands down both length on both sides of the do it yourself cover,
inserting said hooks into all four holes of the material,
bringing together both elasticized bands in the middle of the base of the underside of the chair join together;
clicking said bands into a coupling clasp to create an X to further secure the cover,
placing back the chair seat on its former frame,
resecuring the chair seat to the frame with screws.

Another aspect of the present invention provides a method for replacing a seat cover, using easily replaceable and washable stretch materials, in many colors, cut to fit most moderns padded dinning chairs.

Yet another aspect provides a method for replacing a seat cover, using a weather round, square or other design cover, stitched with a stretched elasticized band around the entire cut shape of the measured material to create a dome or cap to take the shape or form of the chair that is being fitted.

In a further aspect of the present invention, the cover includes four holes cut into the four opposite corners of the material, being each hole stitched around for durability and to avoid tearing.

In still a further aspect of the present invention, hooks will be attached to each end of elasticized stretch bands that will extend to both holes on the length side of both materials. Both elasticized bands will be brought to the middle of the underside of the chairs, and then clasp together by a coupling.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Figure 1:
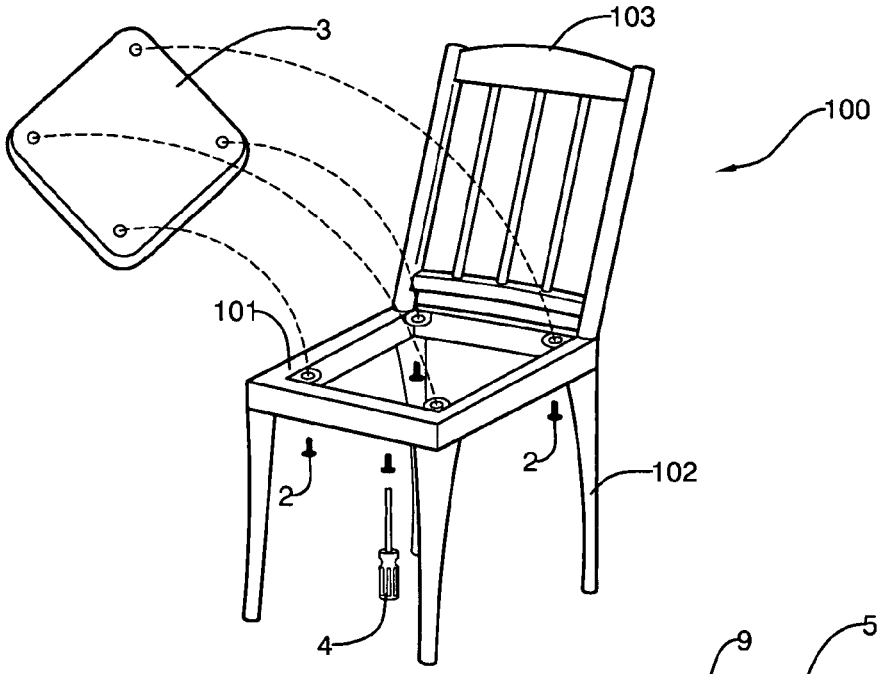
FIG. 1 is a general perspective view of a dinning room chair showing its padded seat separated from the frame of the chair that is being secured.

Shown throughout the Figures, the invention is directed to a method for replacing a seat cover comprising:

removing the screws 2 from the underside 3 with a provided screw driver 4 of the dinning room chair 100 that includes a seat frame 101, four legs 102 and a back 103, lifting the padded seat 5, placing the do-it-yourself cover 6 over the padded seat 5, providing hooks 7 with elasticized stretch bands 8 down both length on both sides of the do it yourself cover 6, inserting said hooks 7 into all four holes 9 of the material of the cover 6;

bringing together both elasticized bands 8 in the middle of the base of the underside 3 of the chair seat join together;

clicking said bands into a coupling clasp 10 to create an X to further secure the cover 6, placing back the padded re-holstered chair seat 5 on its former frame 101, resecuring the padded chair seat 5 to the frame 101 with screws 2.

The material used to manufacture the seat cover 6 may be an easily replaceable and washable stretch material, in many colors, cut to fit most modems padded dinning chairs.

Said cover 6 may take any appropriate form, weather round, square or the like, stitched with a stretched elasticized band 6' around the entire cut shape of the measured material to create a dome or cap to take the shape or form of the chair 100 that is being fitted.

Figure 2:
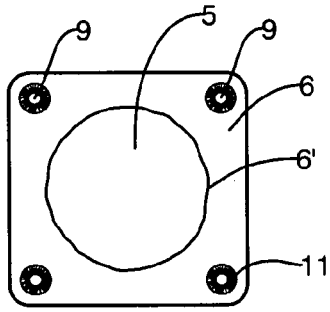
FIG. 2 is a top plan view of the underside of a chair seat using a seat cover including four corner stitched holes.

Cover 6 also includes four holes 9 each cut into the four opposite corners of the material, being each hole stitched around (see 11 in FIG. 2) for durability and to avoid tearing.

Figure 4:
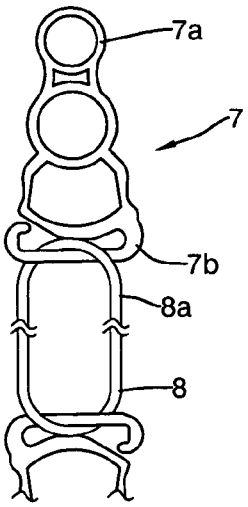
FIG. 4 is a general perspective view of the hooks and elasticized bands used to adjust the cover to the padded seat.
Figure 3:
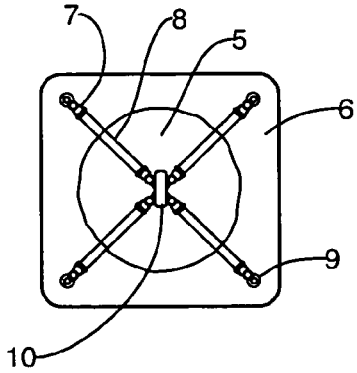
FIG. 3 is another top plan view similar to FIG. 2, this time illustrating the elasticized bands in a cross-like arrangement and a clasp coupling them, finally.

The above mentioned hooks are illustrated in detail in FIG. 4. Each hook comprise at one end a rounded head 7*a* capable of being attached to the hole 9 of the seat 5, and a hook-like end 4*b*. The end 8*a* of the elasticized stretch band 8 will slide over this hook-like end 7*b* and then extend to the diagonally-opposed hole 9.

The rounded end 7*a* of said hook 7 is clip to the material of the seat cover 6.

Both elasticized bands 8 will be brought to the middle of the underside 3 of the chair seat 5, and then clasp together by a coupling 10.

While the preferred embodiments of the invention have been described above, it will be recognized and understood that various modifications can be made in the invention and the appended claims are intended to cover all such modifications which may fall within the spirit and scope of the invention

I claim:

1. A method for replacing a seat cover comprising a chair with a seat frame, a padded seat with four corners, a back support structure, at least one securing device, at least one threaded hole, at least one hook with an annular opening, at least one elasticized stretch band, an elasticized seat cover, and a centralized coupling clasp, the method further comprising:

a) removing the at least one securing device from at least one threaded hole on an underside of the padded seat; then b) lifting the padded seat from the seat frame; then c) removing the elasticized seat cover from the padded seat; then c) placing a new elasticized seat cover over the padded seat; then d) stretching the elasticized seat cover over four corners of the padded seat; then e) returning the padded seat to the seat frame; then f) locating at least one threaded hole on the underside of the padded seat; then g) aligning the annular opening of the at least one hook over the at least one threaded hole on the underside of the padded seat; then h) placing the at least one securing device in the annular opening of the at least one hook and securing the at least one hook and new elasticized seat cover to the padded seat by rotating the at least one securing device in the at least one threaded hole; and then i) attaching the at least one elasticized stretch band to the centralized coupling clasp and interlocking the at least one elasticized stretch band to the centralized coupling clasp, thereby stabilizing the new elasticized seat cover to the padded seat.

2. The method according to claim 1, wherein a set of four elasticized stretch bands are attached to the centralized coupling clasp and the set of four elasticized stretch bands are interlocked to the coupling clasp to form a criss-cross or "x" structural shape in a center of the underside of the padded seat.

3. The method according to claim 1, wherein a set of two elasticized stretch bands are attached to the centralized coupling clasp and the set of two elasticized stretch bands are interlocked to the coupling clasp to form a criss-cross or "x" structural shape in a center of the underside of the padded seat.

* * * * *